US009144255B1

(12) United States Patent
Perciballi

(10) Patent No.: US 9,144,255 B1
(45) Date of Patent: Sep. 29, 2015

(54) SYSTEM FOR ATTACHING ACCESSORIES TO TACTICAL GEAR

(71) Applicant: Armorworks Enterprises, LLC, Chandler, AZ (US)

(72) Inventor: William J. Perciballi, Phoenix, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 259 days.

(21) Appl. No.: 13/756,792

(22) Filed: Feb. 1, 2013

Related U.S. Application Data

(60) Provisional application No. 61/594,199, filed on Feb. 2, 2012.

(51) Int. Cl.
*A41D 27/00* (2006.01)
*A41D 13/00* (2006.01)

(52) U.S. Cl.
CPC ..... *A41D 27/00* (2013.01); *A41D 13/0012* (2013.01)

(58) Field of Classification Search
CPC ..... A41D 13/0012
USPC ..... 2/2.5, 94, 102, 100, 249, 266, 265, 321; 24/578.13, 468, 464, 3.7
See application file for complete search history.

(56) References Cited

U.S. PATENT DOCUMENTS

| | | | | |
|---|---|---|---|---|
| 5,724,707 | A | 3/1998 | Kirk et al. | |
| 7,047,570 | B2 | 5/2006 | Johnson | |
| 7,200,871 | B1 | 4/2007 | Carlson | |
| 7,424,748 | B1 | 9/2008 | McDunn et al. | |
| 7,644,449 | B2 * | 1/2010 | Hellweg | 2/247 |
| 7,694,862 | B2 | 4/2010 | Bergeron | |
| 7,963,427 | B2 | 6/2011 | Calkin | |
| 2012/0180184 | A1 | 7/2012 | Crye | |

OTHER PUBLICATIONS

First Spear "New Technologies" website page: http://www.first-spear.com/pages.php?pageid=20.

* cited by examiner

*Primary Examiner* — Khoa Huynh
*Assistant Examiner* — Khaled Annis
(74) *Attorney, Agent, or Firm* — James L Farmer

(57) ABSTRACT

Designs and methods are provided for a reversible, textile-based tactical article. In one embodiment the tactical article comprises a textile based panel perforated with an array of slots arranged in vertical and horizontal, spaced apart rows. The panel may be adapted for attaching accessories to either side by lacing a strap through a row of the slots and through webbing loops on the accessory positioned between the slots. One side of the panel may have a first appearance, and the other side a second appearance that is different from the first appearance.

12 Claims, 3 Drawing Sheets

SYSTEM FOR ATTACHING ACCESSORIES TO TACTICAL GEAR

This application claims the benefit of U.S. Provisional Application No. 61/594,199, filed Feb. 2, 2012, the entire contents of which are hereby incorporated by reference.

TECHNICAL FIELD AND BACKGROUND

The present invention generally relates to textile-based tactical gear and garments, and in particular to the attachment of accessories to such gear and garments.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
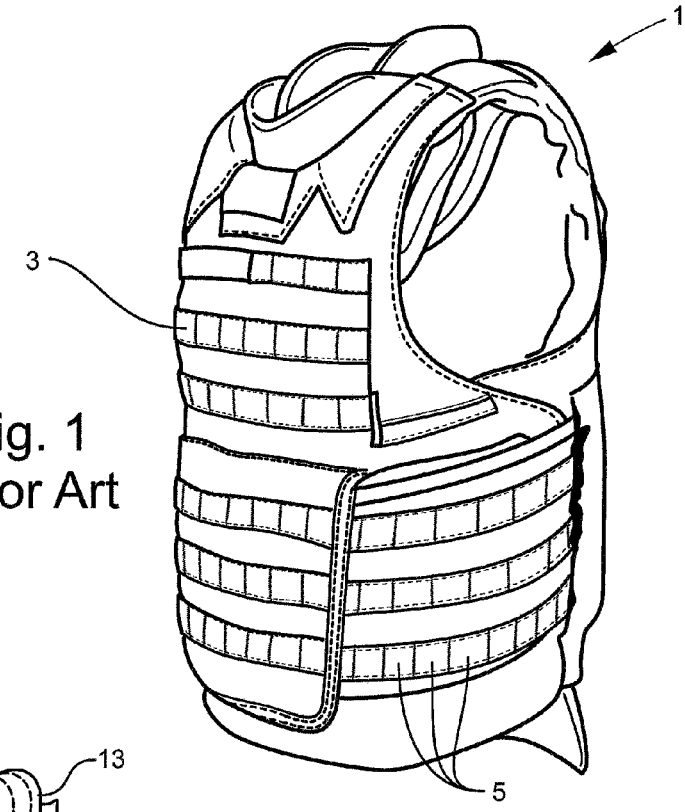
Fig. 1 Prior Art
FIG. 1 is a perspective front view of a prior art tactical vest with MOLLE webbing on the exposed surfaces.

Referring now specifically to the drawings, FIG. 1 depicts a prior art tactical vest 1 typical of those used by military and law enforcement organizations worldwide for protection against ballistic threats. The exposed surfaces of the vest are equipped with the ubiquitous horizontal fabric strips 3 known as webbing, or MOLLE (an acronym for Modular Lightweight Load-bearing Equipment) commonly found on all types of textile based tactical gear, such as backpacks, duffels, pouches, vests, plate carriers, and the like. The webbing strips are intermittently attached, creating an array of loops 5 useful for attaching accessories or other pieces of gear to the outside of the vest by lacing a strap through the loops 5 and similar webbing loops on the back of the accessory. The lacing strap may be permanently attached at one end to the accessory, and fitted at the other end with a snap, or hook and loop system for attaching to the accessory or back to itself.

Figure 2:
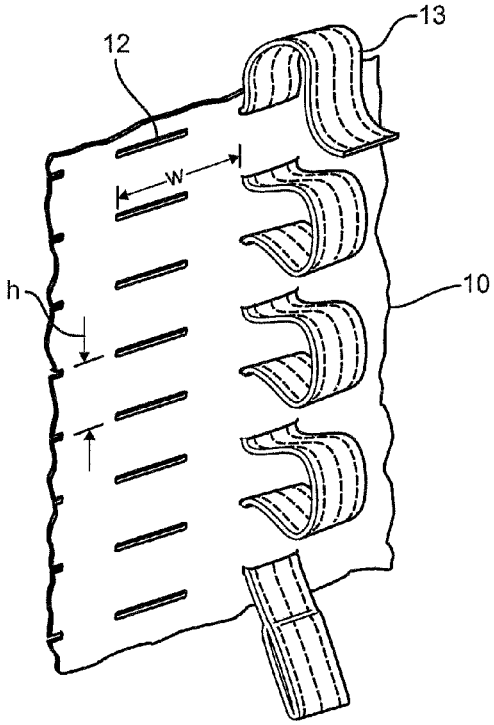
FIG. 2 is a perspective view of a textile panel perforated in accordance with the present disclosure with vertical and horizontal rows of spaced apart slots.

FIG. 2 shows an exemplary system for attaching accessories to a textile-based tactical article in accordance with the present invention. The system comprises a textile shell or panel 10 made of a tough, load bearing material, perforated with an array of horizontal slots 12 arranged in horizontal and vertical spaced apart rows. In one particular embodiment textile panel 10 comprises a durable base fabric with a flexible environmental coating such as chlorosulfinated polyethylene (CSPE) applied to both sides. Suitable durable base fabrics may include for example various forms or weaves of para-aramid fiber, nylon (such as Cordura®), polyester, glass, polyethylene, polypropylene, and the like. The CSPE coating alone, and fabrics rubberized with CSPE are both commonly referred to by the Dupont trade name Hypalon®. Such fabric constructions, although flexible when compared to homogeneous materials like sheet plastic, may be substantially more stable and rigid, and significantly tougher than woven nylon and similar materials when used alone.

In addition, the panel 10 may comprise a rubberized fabric with an additional exterior fabric layer, such as a Cordura type material, laminated to one or both sides. Any suitable bonding agent such as a thermal or pressure activated adhesive may be used to laminate the exterior fabric layer to the rubberized fabric. The exterior fabric layer or layers may be printed with a particular coloring or with different color schemes to give the panel a desired appearance.

Figure 3:
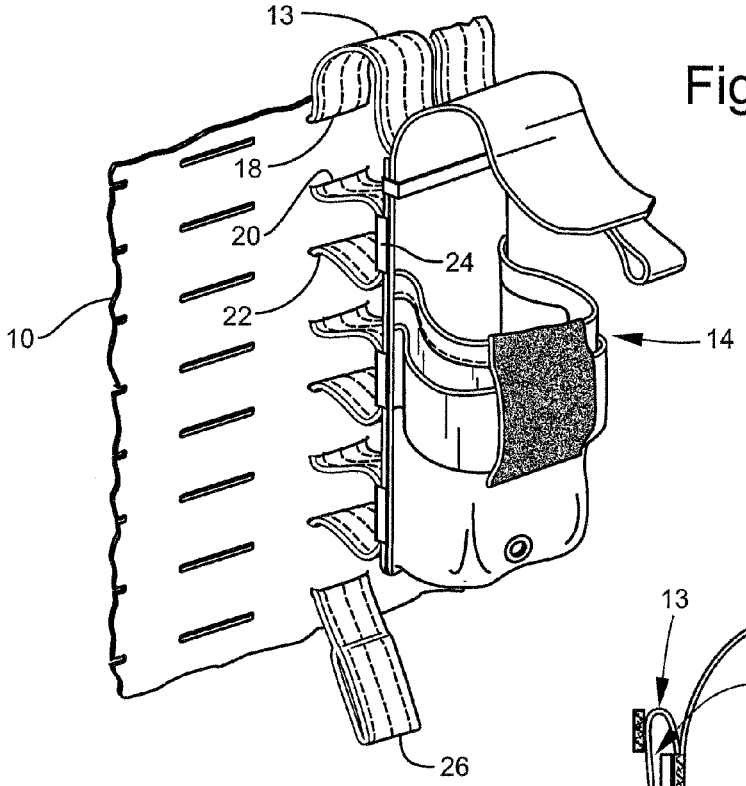
FIGS. 3 and 4 depict an accessory pouch laced to the perforated textile panel of FIG. 2.

Continuing with FIG. 3, the slots 12 are used to lace an accessory to the panel 10 using a strap 13 in essentially the same manner described above for lacing accessories to MOLLE webbing. Accordingly the vertical and horizontal spacing between slots 12 may correspond to the vertical and horizontal spacing typical in a conventional webbing system. For example, in one embodiment the vertical spacing as indicated by 'h' on FIG. 2 is about 1 inch, and the horizontal spacing, or more accurately the horizontal pitch, as indicated by 'w' on FIG. 2 is about 1.5 inches. The slots themselves may be simple slices in the panel formed without removing material, or actual open slots with a measurable width, such as for example between 1/32 inch and 1/8 inch wide.

Figure 4:
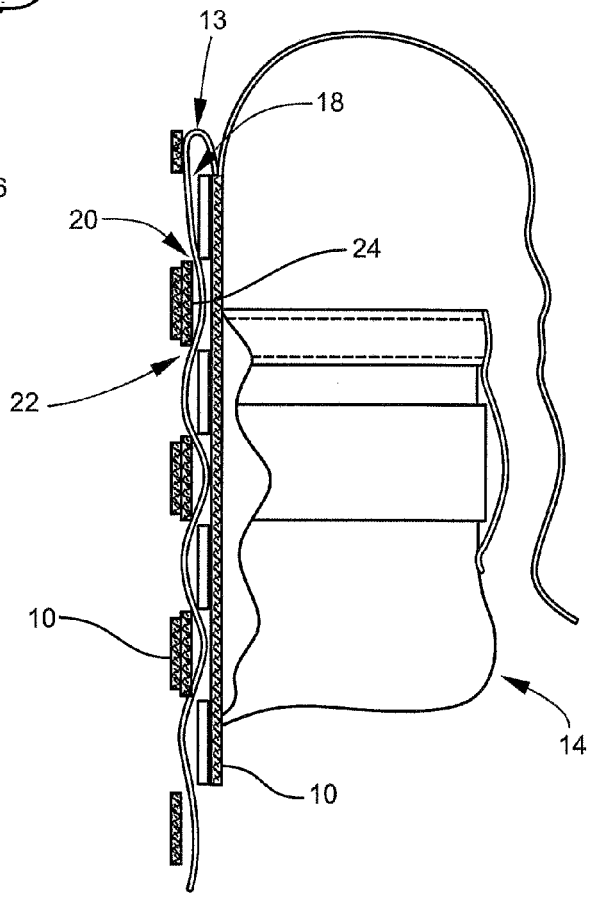

FIGS. 3 and 4 depict an accessory pouch 14 laced to a textile panel 10 using a strap 13 originating from the top of the pouch. The lacing process involves initially passing the free end of strap 13 through a first slot 18 to the back side of the panel 10, and then passing it back through the next lower slot 20 to the front side of the panel. From there the strap is passed down through a web loop 24 on the back of the accessory, and then through the next slot 22 in panel 10 to the back side of the panel. The above process may continue as required to securely attach the accessory pouch to the textile panel. Although only one strap is shown, two or more straps may be used as appropriate for the size and weight of the particular accessory. Once the lacing is complete, the free end 26 of the strap 13 may be attached to the accessory pouch, or back to itself using a suitable fastener such as a snap, or hook and loop strips, or simply tucked in behind the pouch or shell.

Figure 5:
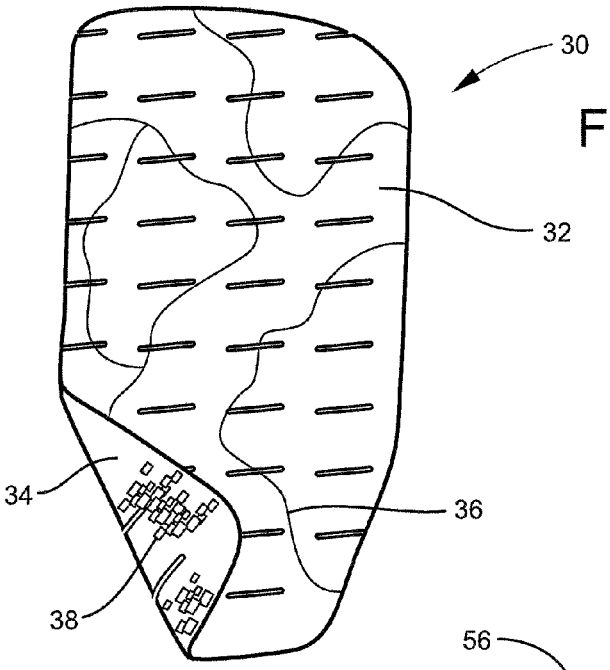
FIG. 5 is a reversible embodiment of a perforated textile panel with a first camouflage pattern on one side, and a second camouflage pattern on the other side.

The attachment system of the present disclosure may be further used to create reversibility. The present inventors have recognized that a textile panel 10 with slots 12, such as described above, is symmetrical in that either side may be used for attaching accessories or gear. Referring now to FIG. 5, a reversible textile panel 30 comprises a first side 32 with a first appearance, and a second side 34 with a second appearance. The first and second appearances may be for example different colors, different surface textures, or different infrared signatures. In one particular exemplary embodiment the first appearance is a first camouflage pattern 36, and the second appearance is a second camouflage pattern 38. For example, the first camouflage pattern may be an analog type such as woodland camouflage, and the second camouflage pattern may a digital type such as the MARPAT camouflage. The camouflage patterns may be printed on exterior fabric layers laminated to a rubberized load bearing fabric as discussed above. The panel 30 may comprise any of the textile based types of tactical gear and clothing discussed previously, such as packs, pouches, duffels, vests, shirts, and plate carriers, to name a few.

Figure 6:
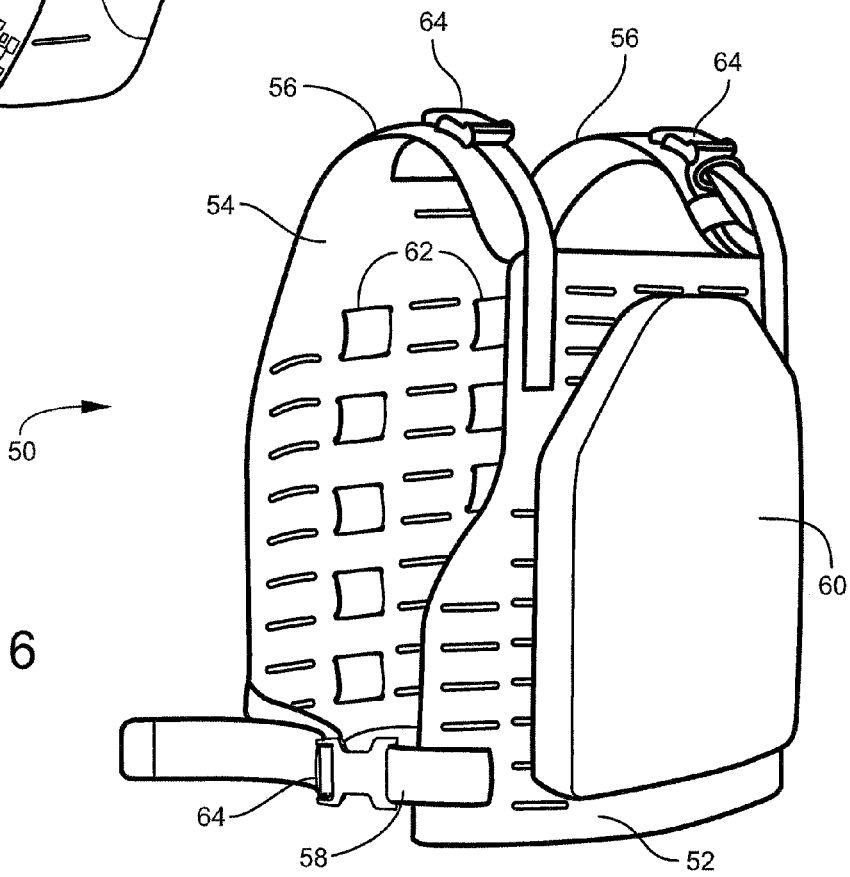
FIG. 6 is a perspective view of a reversible plate carrier in accordance with the present disclosure.

In one example, a reversible tactical article comprises a reversible plate carrier 50 with front and back reversible panels 52, and 54 respectively, as shown in FIG. 6. Panels 52, 54, are detachably connected at the top by shoulder straps 56, and at the sides by side straps 58. Armor plate carrying pouches 60, each for holding a Small Arms Protective Inserts (SAPI), are laced to the outer facing surfaces of panels 52, 54 using straps 62 in the same manner described above in reference to the accessory pouch 14 of FIG. 3. Reversible panels 52, 54 further comprise a first camouflage pattern on the outer facing surfaces, and a second camouflage pattern on the inward facing surfaces.

The plate carrier 50 may be reversed by first detaching the buckles 64 in shoulder and side straps 56, 58, and separating panels 52, 54. The armor carrying pouches 60 may be unlaced and removed from the outer facing surfaces, and re-attached to the formerly inward facing surfaces of panels 52, 54. The panels 52, 54, are inverted from the prior orientation, and buckles 64 re-connected. Thus the plate carrier is reversed, with the second camouflage pattern now on the outer facing surfaces, and the first camouflage pattern on the inward facing surfaces.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A reversible armor plate carrier, comprising:

load bearing, single layer, front and back textile panels when worn, each with two opposed surfaces having two sides, either of which may serve as an outer facing surface, the panels perforated with an array of slots arranged in evenly spaced vertical and horizontal rows, and made of a durable base fabric coated on the two sides with a flexible environmental coating;

a pair of shoulder straps with buckles detachably connecting upper ends of the front and back textile panels together, and a pair of side straps with buckles detachably connecting left and right side portions of the front and back textile panels together, thereby defining a wearable configuration in which one of the two opposed surfaces of each of the front and back textile panels is outward facing and the other is inward facing, the straps and buckles connectable when either of the two opposed surfaces of a front or back textile panel is outward facing;

front and back armor pouches having attached lacing straps designed for holding small arms protective inserts, and attached respectively to the outward facing surfaces of the front and back textile panels by passing a free end of the lacing straps through to the front and back panel slots in the textile panels, the armor pouches substantially covering the outer facing surfaces of the front and back textile panels; and front and back small arms protective insert armor plates contained respectively in the front and back armor pouches.

2. The reversible armor plate carrier of claim 1, wherein the durable base fabric comprises a woven fiber selected from the group consisting of para-aramid, nylon, polyester, glass, polyethylene, and polypropylene.

3. The reversible armor plate carrier of claim 1, wherein the flexible environmental coating is chlorosulfinated polyethylene.

4. The reversible armor plate carrier of claim 1, wherein the slots are horizontal, and a vertical spacing between slots is about 1 inch.

5. The reversible armor plate carrier of claim 4, wherein a horizontal pitch between adjacent slots is about 1.5 inches.

6. The reversible armor plate carrier of claim 5, wherein the vertical width of a slot is between 1/32 inch and 1/8 inch.

7. The reversible armor plate carrier of claim 1, wherein the front and back textile panels each have a first coloring on one of the two opposed surfaces, and a second coloring on the other of the two opposed surface.

8. The reversible armor plate carrier of claim 7, wherein the first coloring is a first camouflage, and the second coloring is a second camouflage.

9. The reversible armor plate carrier of claim 1, further comprising an external fabric layer laminated to the environmental coating on at least one of the opposed surfaces of the load bearing textile panels.

10. A reversible armor plate carrier, comprising:

single layer, front and back textile panels when worn made of a load bearing material, each with two opposed surfaces and perforated with an array of slots arranged in vertical and horizontal, spaced apart rows;

a pair of shoulder straps with buckles detachably connecting upper ends of the front and back textile panels together, and a pair of side straps with buckles detachably connecting left and right side portions of the front and back textile panels together, thereby defining a wearable configuration in which one of the two opposed surfaces of each of the front and back textile panels is outward facing and the other is inward facing, the straps and buckles connectable when either of the opposed surfaces of a front or back textile panel is outward facing;

front and back armor pouches having attached lacing straps designed for holding small arms protective inserts, and attached respectively to the outer facing surfaces of the front and back textile panels by passing a free end of the lacing straps through to the front and back panel slots in the textile panels, the armor pouches substantially covering the outer facing surfaces of the front and back textile panels; and front and back small arms protective insert armor plates contained respectively in the front and back armor pouches.

11. The reversible armor plate carrier of claim 10, wherein the load bearing material is a rubberized fabric.

12. The reversible armor plate carrier of claim 11, wherein the rubberized fabric is a durable woven base fabric coated with chlorosulfinated polyethylene.

* * * * *